US007850207B1

(12) United States Patent
Valenti, Jr. et al.

(10) Patent No.: US 7,850,207 B1
(45) **Date of Patent: *Dec. 14, 2010**

(54) MULTI-PART LABELS WITH VARIABLE DATA ON AT LEAST TWO LAYERS

(75) Inventors: F. Paul Valenti, Jr., Barrington, IL (US); Carl Opel, Carol Stream, IL (US); Daniel Hedger, Grayslake, IL (US)

(73) Assignee: Chicago Tag & Label, Inc., Libertyville, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/755,209

(22) Filed: May 30, 2007

Related U.S. Application Data

(63) Continuation-in-part of application No. 11/533,447, filed on Sep. 20, 2006.

(60) Provisional application No. 60/718,709, filed on Sep. 20, 2005.

(51) Int. Cl.
*B42D 15/00* (2006.01)

(52) U.S. Cl. ..... 283/81; 283/101; 283/107; 283/61; 283/62; 283/109

(58) Field of Classification Search ..... 40/299.01, 40/638; 156/247; 283/61, 62, 81, 101, 107, 283/109, 904; 428/204, 916; *G09F 3/02, G09F 3/10*

See application file for complete search history.

(56) References Cited

U.S. PATENT DOCUMENTS

| | | | | |
|---|---|---|---|---|
| 4,951,970 | A * | 8/1990 | Burt | 283/81 |
| 5,083,979 | A * | 1/1992 | Burt | 462/3 |
| 5,639,125 | A * | 6/1997 | Garrison | 283/81 |
| 2003/0127180 | A1 * | 7/2003 | Williams | 156/247 |

OTHER PUBLICATIONS

Color photocopy of two-layer label that included variable data on the bottom layer (date of publication unknown but at least as early as Oct. 2005).

* cited by examiner

*Primary Examiner*—Dana Ross
*Assistant Examiner*—Justin V Lewis
(74) *Attorney, Agent, or Firm*—Ice Miller LLP

(57) ABSTRACT

A multi-part label with variable data and method for its manufacture. First indicia may be printed on a first label face ply of a multi-ply label material in registration with an eventual location of at least one of a plurality of multi-part labels. The first indicia may be variable between at least two of the plurality of multi-part labels. A second label material may be removably adhered to the multi-ply first label material, thereby covering the first indicia. Second indicia may be printed on the face of the second label material. The second indicia may be variable between at least two of the plurality of multi-part labels.

1 Claim, 6 Drawing Sheets

MULTI-PART LABELS WITH VARIABLE DATA ON AT LEAST TWO LAYERS

This application is a continuation-in-part of U.S. Ser. No. 11/533,447, filed Sep. 20, 2006, which claims priority from U.S. Provisional Patent Application Ser. No. 60/718,709, filed Sep. 20, 2005. The disclosures of these applications are incorporated herein by reference.

BACKGROUND

Labels are commonly used to secure printed indicia to packages to indicate shipping or other information. In the instance of a shipping use, a customer is often provided with a label that is separate from the package to be shipped. The separate label will be enclosed within a package shipped to the customer containing a purchased item. The separate label is generally preprinted for use if the customer wants to return the item. The customer is generally responsible for properly preparing the label for adhesion to the package by removing a liner. The customer must then properly position it and affix the label. Difficulties during use may arise if the separate label is lost, becomes damaged, or is improperly positioned on the package.

For the foregoing reasons, it is desired to provide a shipping return label that reduces the frequency of times item return labels are lost, damaged, or improperly positioned.

SUMMARY

An aspect of the present disclosure comprises a method for manufacturing a plurality of multi-part labels. At least one embodiment of such a method may comprise the steps of providing a first label material comprising a first label face, printing first indicia on the first label face in registration with an eventual location of at least one of a plurality of multi-part labels where the first indicia may be variable between at least two of the plurality of multi-part labels, removably adhering a second label material to the first label material where the second label material covers the first indicia and comprises a second label face, and printing second indicia on the second label face in registration with the first indicia on the first label face, where the second indicia may be variable between at least two of the plurality of multi-part labels. According to an aspect of at least one embodiment of the present disclosure, a first label material may be a multi-ply first label material comprising a liner ply and a first label face ply, where the first label face ply comprises a label face and may be removably adhered to the liner ply. According to an aspect of at least one embodiment of the present disclosure, a second label material may be removably adhered to a first label material by a repositionable adhesive. According to an aspect of the present disclosure, a method according to an embodiment of the present disclosure may comprise the step of applying a release coat material to the first label face in registration with an eventual location of at least one of the plurality of multi-part labels. According to an aspect of the present disclosure, a method according to an embodiment of the present disclosure may comprise the step of defining boundaries of at least one of a plurality of multi-part labels.

An aspect of the present disclosure comprises a system for producing a plurality of multi-part labels. At least one embodiment of such a system comprises a source of a first label material comprising a first label face, a source of a second label material comprising a second label face, a laminator operable to adhere a second label material to the first label material in a manner covering the first indicia, a first printer, and a second printer. According to an aspect of at least one embodiment of a system according to the present disclosure, a first printer may be operable to print first indicia on a first label face in registration with an eventual location of at least one of a plurality of multi-part labels, where the first indicia may be variable between at least two of the plurality of multi-part labels, and a second printer may be operable to print second indicia on a second label face in registration with the first indicia on the first label face, where the second indicia may be variable between at least two of the plurality of multi-part labels.

According to an aspect of the present disclosure, a system according to at least one embodiment of the present disclosure may comprise a release coat applicator operable to apply a release coat material to a first label face in registration with an eventual location of at least one of a plurality of multi-part labels. According to an aspect of the present disclosure, a system according to at least one embodiment of the present disclosure may comprise a die cutter operable to define boundaries of at least one of a plurality of multi-part labels. According to an aspect of at least one embodiment of the present disclosure, a first label material may be a multiply first label material comprising a liner ply and a first label face ply that may be removably adhered to the liner ply, where a die cutter according to at least one embodiment of the present disclosure may be operable to define boundaries of at least one of a plurality of multi-part labels while retaining at least one of the plurality of multi-part labels in removable adherence to the liner ply.

An aspect of the present disclosure comprises a plurality of multi-part labels. At least one embodiment of such a plurality of multi-part labels comprises first label material comprising a first label face, first indicia printed on the first label face where the first indicia may be variable between at least two of the plurality of multi-part labels, a second label material comprising a second label face and removably adhered to the first label material by a repositionable adhesive in a manner covering the first indicia, and second indicia printed on the second label face in registration with the first indicia on the first label face, where the second, indicia may be variable between at least two of the plurality of multi-part labels. According to an aspect of at least one embodiment of a plurality of multi-part labels according to the present disclosure, a first indicia of a first label material is not defaced when a second label material is removed therefrom. According to an aspect of at least one embodiment of the present disclosure, a first label material comprises a first label face ply and a liner ply where the first label face ply may be removably adhered to the liner ply, and where boundaries of at least one of a plurality of multi-part labels are defined in the first label face ply.

BRIEF DESCRIPTION OF THE DRAWINGS

The features and advantages of this disclosure, and the manner of attaining them, will be more apparent and better understood by reference to the following descriptions of the disclosed methods and systems, taken in conjunction with the accompanying drawings, wherein.

DESCRIPTION

Figure 1:
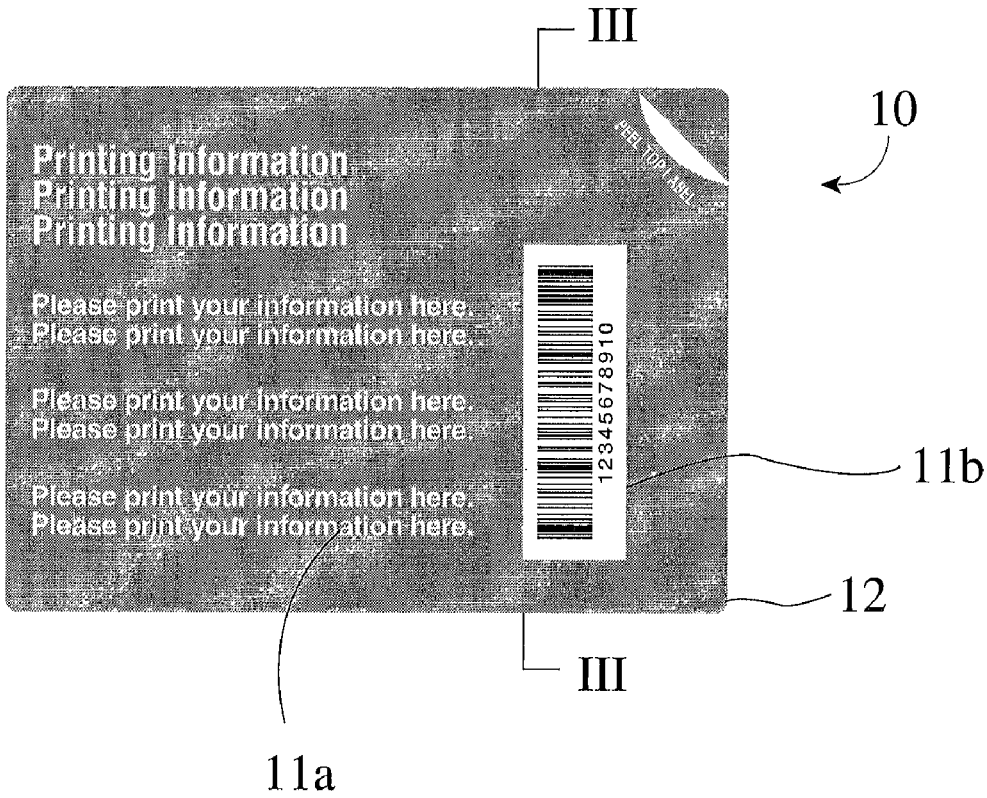
FIG. 1 shows a top view of a multi-part label according to at least one embodiment of the present disclosure.

For the purposes of promoting an understanding of the principles of the present disclosure, reference will now be made to the embodiments illustrated in the drawings, and specific language will be used to describe the same. It will nevertheless be understood that no limitation of the scope of this disclosure is thereby intended.

According to at least one embodiment of the present disclosure, a multi-part label generally includes at least three plies of material including a liner, a middle label material, and a top label material. However, it is within the scope of the present disclosure that a multi-part label may include more than three plies of material.

In at least one embodiment of a multi-part label according to the present disclosure comprising three plies of material, the three plies of material are layered on top of one another in the following sequence from bottom to top: liner, middle label material, and then top label material. The liner may be a silicone coated liner. Adhesive is located between the liner and the middle label material. Adhesive also is located between the middle label material and the top label material. The adhesive between the liner and the middle label material may be coextensive with the surface area of the middle label material, but it is not required that the adhesive be coextensive with the surface area of the middle label material. Likewise, the adhesive between the middle label material and the top label material may be co-extensive with the surface area of the top label material, but it is not required that the adhesive be coextensive with the surface area of the top label material.

In at least one embodiment of a multi-part label according to the present disclosure comprising three plies of material, the middle label material and top label material may be substantially the same size. In other embodiments, the middle label material and top label material may be different sizes.

FIG. 1 shows a top view of multi-part label 10 according to at least one embodiment of the present disclosure. Multi-part label 10 of FIG. 1 comprises top ply 12, middle ply 14, and liner 16, although only top ply 12 of multi-part label 10 is visible in FIG. 1. Top ply 12 may comprise indicia 11*a*, 11*b*. Such indicia may be information such as, for example, return and/or mailing addresses, a tracking number, bar codes, maxicodes, billing account information, and/or directions on how to use multi-part label 10. Such indicia may include information useable by a shipping company such as, for example, United Parcel Service, the U.S. Postal Service, or DHL, among others.

According to at least one embodiment of the present disclosure, indicia 11*a*, 11*b* may be variable, or different, between a two discrete multi-part labels. In another embodiment of the present disclosure indicia 11*a*, 11*b* may be static, or the same, between a two discrete multi-part labels. Where variable indicia is used, it may provide a means, for example, for a unique bar code, unique identifying number, unique shipping address, or unique maxicode for each multi-part label in a series of multi-part labels.

Figure 2:
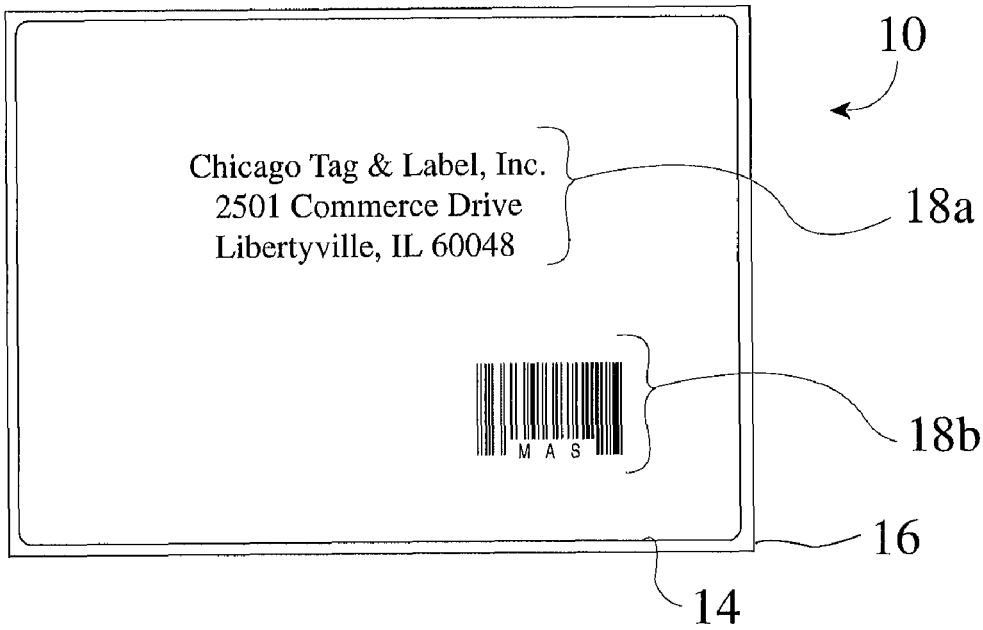
FIG. 2 shows a top view of a multi-part label according to at least one embodiment of the present disclosure with a top ply removed.

FIG. 2 shows a top view of multi-part label 10 with top ply 12 removed. Visible in FIG. 2 are middle ply 14 and liner 16. Middle ply 14 comprises indicia 18*a*, 18*b* printed thereon. Indicia 18*a*, 18*b* generally includes printed indicia. The printed indicia on the middle label material may be information such as, for example, return and/or mailing addresses, a tracking number, bar codes, maxicodes, billing account information, or other relevant information. Such indicia may include information useable by a shipping company such as, for example, United Parcel Service, the U.S. Postal Service, or DHL, among others. According to embodiments of the present disclosure, such indicia may be variable or static. Where variable indicia is used, it may provide a means, for example, for a unique bar code, unique identifying number, unique shipping address, or unique maxicode for each multi-part label in a series of multi-part labels.

Figure 3:
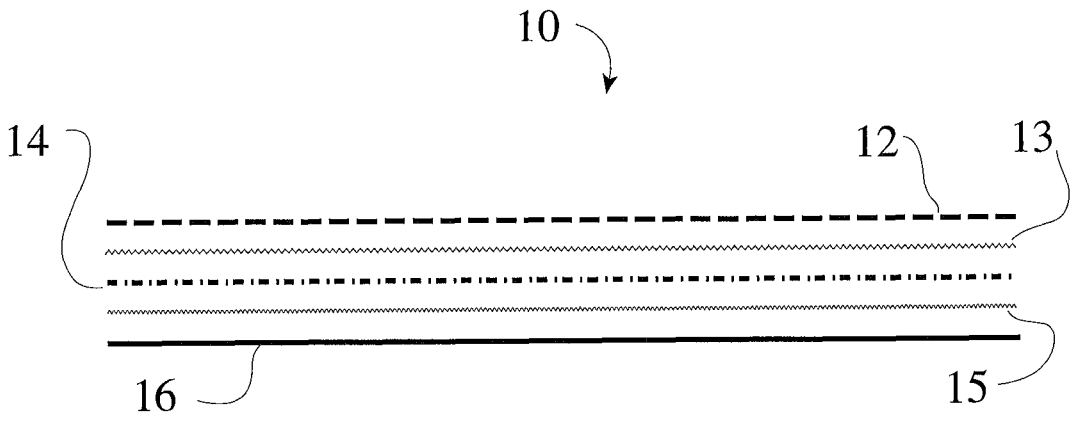
FIG. 3 shows a cross-sectional end view of a multi-part label according to at least one embodiment of the present disclosure.

FIG. 3 shows a cross-sectional end view of multi-part label 10, taken on line III-III of FIG. 1. Shown in FIG. 3 are top ply 12, first adhesive layer 13, middle ply 14, second adhesive layer 15, and liner 16. Top ply 12 is removably adhered to middle ply 14 by first adhesive layer 13. Middle ply 14 is removably adhered to liner 16 by second adhesive layer 15. Liner 16 may be a silicone liner.

The adhesive of first adhesive layer 13 is selected so as to securely adhere top ply 12 to middle ply 14 until it is desired to remove top ply 12 from middle ply 14. The adhesive of first adhesive layer 13 is selected so as to promote removability of top ply 12 when removal of top ply 12 is desired, while mitigating or eliminating the possibility that indicia that may be printed on middle ply 14 will be defaced when top ply 12 is removed therefrom. In at least one embodiment, first adhesive layer 13 comprises a pressure sensitive adhesive. In at least one embodiment, a release coat optionally may be applied to middle ply 14 to promote removability of top ply 12. Where used, the release coat is selected so as to be compatible with the adhesive of first adhesive layer 13 in producing the desired removability of top ply 12, while also mitigating or eliminating the possibility that indicia that may be printed on middle ply 14 will be defaced when top ply 12 is removed therefrom. In at least one embodiment, the adhesive of adhesive layer 13 is a repositionable adhesive. Accordingly, top ply 12 may be removed from middle ply 14, and top ply 12 may be re-adhered to one or more other surface(s).

The adhesive of second adhesive layer 15 is selected so as to securely adhere middle ply 14 to liner 16 until it is desired to remove middle ply 14 from liner 16. In at least one embodiment, second adhesive layer 15 comprises a pressure sensitive adhesive. In at least one embodiment, a release coat optionally may be applied to liner 16 to promote removability of middle ply 14. Where used, the release coat is selected so as to be compatible with the adhesive of second adhesive layer 15 in producing the desired removability of middle ply 14. In at least one embodiment, liner 16 may be a silicone coated liner. Middle ply 14 may be removed from liner 16, and then middle ply 14 may be adhered one or more other surface(s).

Figure 4:
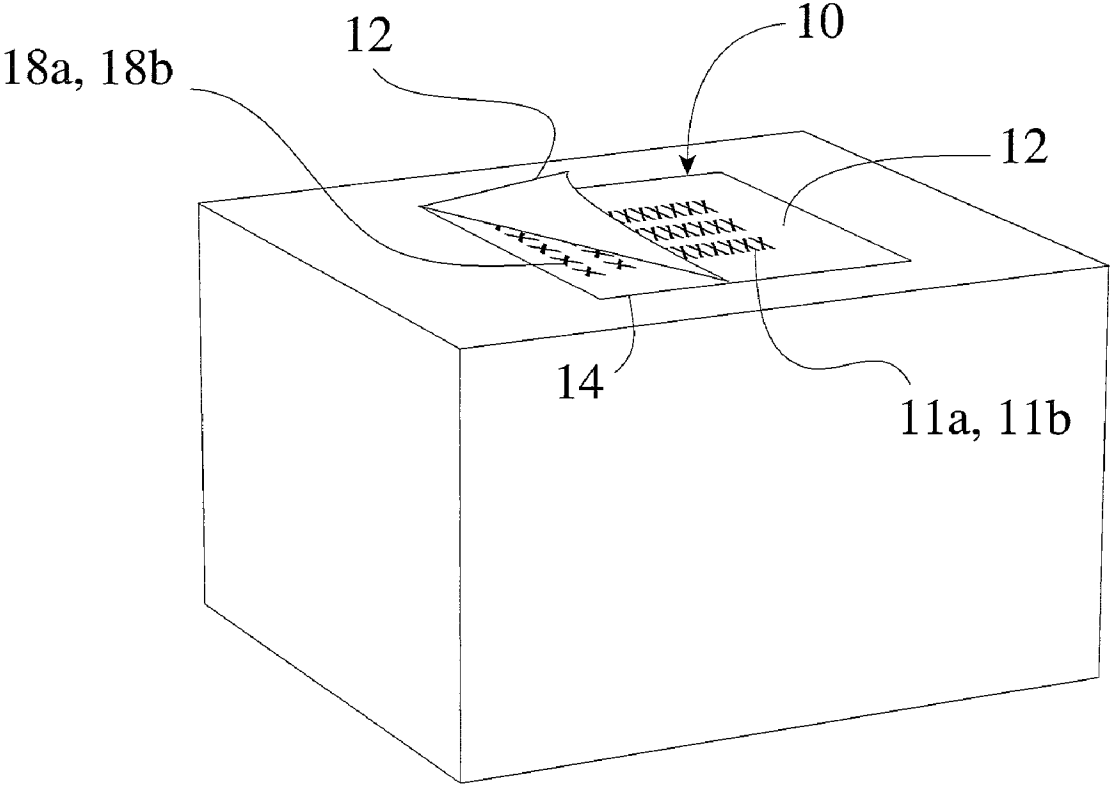
FIG. 4 shows a multi-part label according to at least one embodiment of the present disclosure, as implemented on a package.

FIG. 4 shows at least one embodiment of multi-part label 10 of FIG. 1, as implemented on a package. Indicia 11*a*, 11*b* is visible on the surface of top ply 12. According to this embodiment, multi-part label 10 may be affixed to a package by removing liner 16 from the underside of middle ply 14 to reveal second adhesive layer 15. Pressure is applied to top ply 12, thereby adhering the underside of middle ply 14 to the package. In the event it is desired to re-use the box, such as, for example, to return an item to the original sender, the top ply 12 may be removed, thereby revealing indicia 18*a*, 18*b* printed on middle ply 14. First adhesive layer 13 adheres to the underside of top ply 12, but not to middle ply 14. The package may be resealed and delivered to an appropriate shipping or mail service.

A multi-part label according to the present disclosure may be used where it is desirable that the customer have an easy means for returning some portion of the purchased merchandise to the merchant or a third party. For example, in mail order clothing sales, the customer may want to return some items to the merchant. Another industry where a multi-part label according to the present disclosure may be useful is for the recycling of used toner cartridges. The customer purchases a package of toner cartridges from a retailer or a mail order merchant. After the toner cartridges are expended, the customer places the used cartridges into the package for transport to a third party that refurbishes and recycles the cartridges. To use the label after receipt of the package, the customer removes the merchandise and saves the package. When it becomes necessary to return the merchandise for whatever reason, the customer peels off the top label material to expose the shipping indicia printed on the middle label material and transfers the package to a shipping company. The shipping company uses the printing on the middle label material to deliver the package and to bill for its service.

Figure 5:
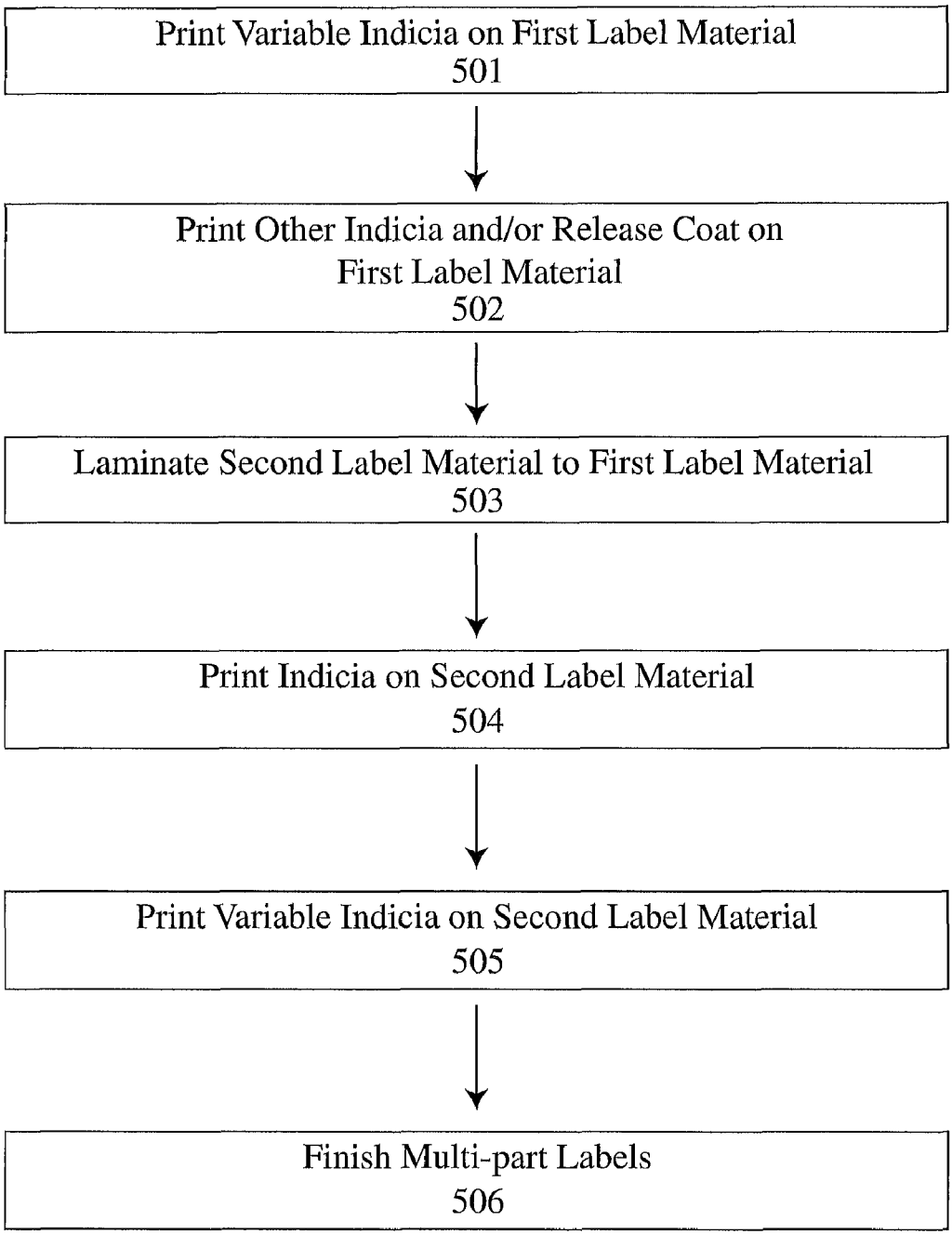
FIG. 5 shows a flowchart illustrating a method according to at least one embodiment of the present disclosure.

In at least one embodiment of the present disclosure, at least one discrete multi-part label, such as, for example, multi-part part label 10, is formed from a continuous roll or web of label material. In at least one embodiment of the present disclosure, such a plurality of discrete multi-part labels include variable indicia. FIG. 5 shows a flowchart illustrating a method according to at least one embodiment of the present disclosure for creating a plurality of discrete multi-part labels from a continuous roll or web of label material, wherein such labels include variable indicia. In step 501 of FIG. 5, variable indicia is printed on a first label material, which may be a liner-backed label material. In step 502 of FIG. 5, other indicia is printed on the first label material. Optionally, a release coat may be printed on the first label material in addition to or in lieu of the indicia. In step 503 of FIG. 5, a second label material is removably laminated to the first label material, with the second label material arranged in relation to the first label material so that the second label material covers the indicia on the first label material. In step 504 of FIG. 5, indicia is printed on the second label material. In step 505 of FIG. 5, variable indicia is printed on the second label material. In step 506 of FIG. 5, the multi-part labels are finished by one or more finishing processes.

Figure 6:
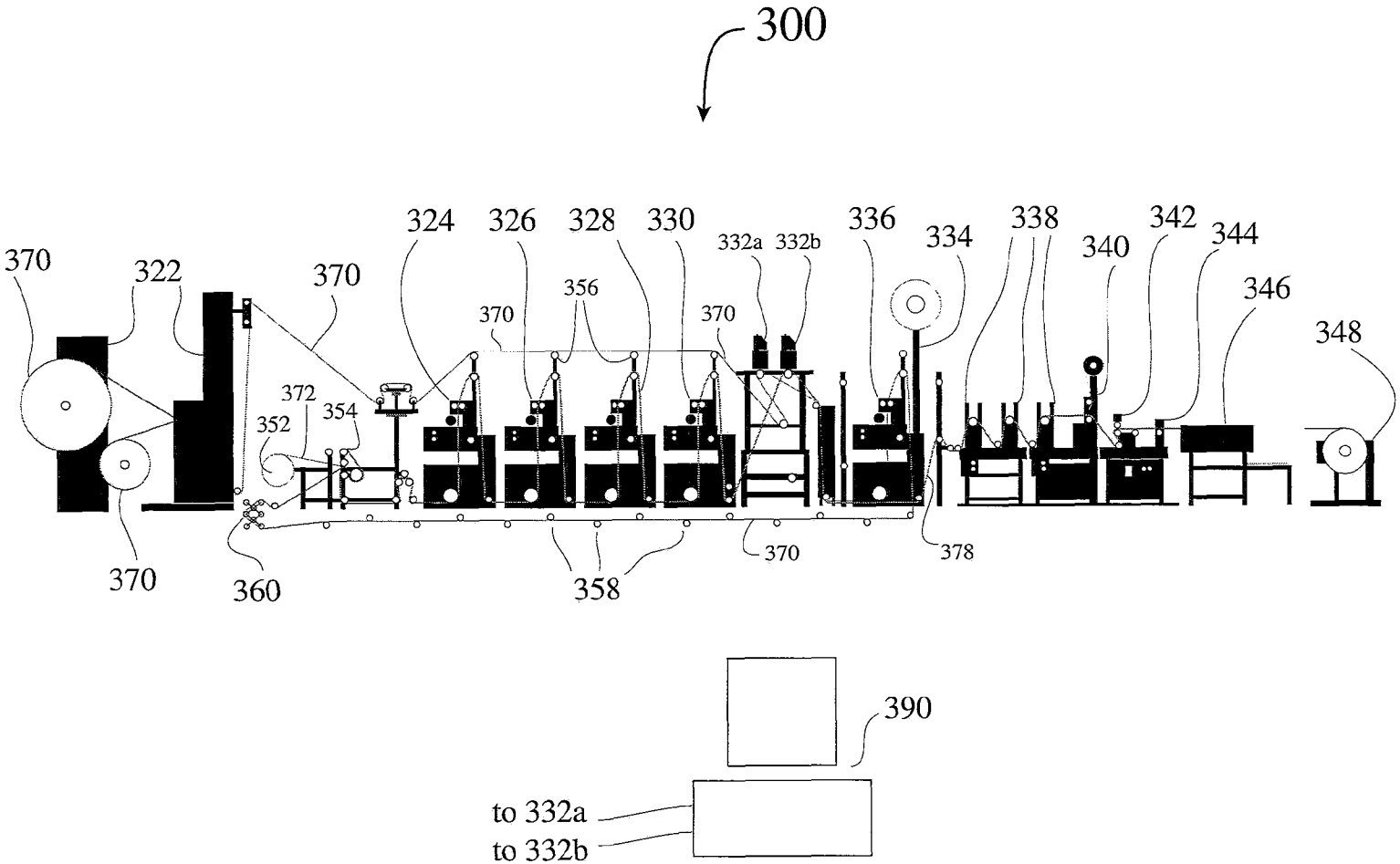
FIG. 6 shows a system according to at least one embodiment of the present disclosure for production of multi-part labels.

FIG. 6 shows system 300 according to at least one embodiment of the present disclosure for automated production of multi-part labels, such as, for example, multi-part label 10. As shown in FIG. 6, at least one roll of first label material 370 is mounted on first material source 322. In at least one embodiment of a system according to the present disclosure, first label material 370 comprises a liner component and a label material component, with a pressure-sensitive adhesive interposed between the liner component and the label material component. In such an embodiment, the label material component of first label material 370 may be readily separated from the liner component of first label material 370, with interposed pressure-sensitive adhesive remaining with the label material component of first label material 370 after separation. In at least one embodiment, the liner component of first label material 370 comprises a silicone coating adjacent to the label material component thereof.

In at least one embodiment of a system according to the present disclosure, when a roll of first label material 370 is exhausted, first material source 322 is operable to splice the next roll of first label material 370 to the end of the exhausted roll to minimize gaps in production, but a splicing function is not required. Also as shown in FIG. 6, at least one roll of second label material 372 is mounted is mounted on second material source 352. In at least one embodiment of a system according to the present disclosure, second label material 372 is an adhesive-backed label stock. In at least one embodiment of a system according to the present disclosure, second label material 372 is an adhesive-backed label stock comprising a repositionable adhesive.

As shown in FIG. 6, in at least one embodiment of system 300 according to the present disclosure first label material 370 is unwound from first material source 322 and fed through system 300 at a predetermined rate. First label material 370 is routed along guides 356 and then is fed under or through first variable printer 332*a*. Guides 356 may be rollers. Variable printer 332*a* is adapted to print indicia (such as, for example, indicia 18*b*) on first label material 370. In at least one embodiment of system 300, variable printer 332*a* is an ink jet printer. In at least one embodiment of system 300, variable printer 332*a* may be a laser printer. The inks, toners, or other printing materials used in variable printer 332*a* are selected to be compatible with variable printer 332*a*, first label material 370, and the intended use of the plurality of multi-part labels to be formed from first label material 370. After being presented with the disclosure herein, one of ordinary skill in the relevant art will realize that other types of printers and other materials may be used to create indicia on first label material 370 without departing from the spirit and scope of the present disclosure.

In at least one embodiment of system 300 according to the present disclosure, variable printer 332*a* is adapted to print variable indicia on first label material 370, i.e., variable printer 332*a* is adapted to print different indicia on at least two of the discrete multi-part labels that are to be formed from the continuous roll or web of first label material 370. In at least one embodiment of system 300 according to the present disclosure, variable printer 332*a* is adapted to print different indicia on each discrete multi-part label that is to be formed from the continuous roll or web of first label material 370. For example, variable printer 332*a* may be adapted to print a different address on different discrete multi-part labels, or may be adapted to print a different bar code on different discrete multi-part labels, or may be adapted to print a different maxicode on different discrete multi-part labels, or may be adapted to print different billing account information on different discrete multi-part labels, or may be adapted to print a different tracking number on different discrete multi-part labels. After being presented with the disclosure herein, one of ordinary skill in the relevant art will realize that other types of variable indicia may be printed without departing from the spirit and scope of the present disclosure.

In at least one embodiment of system 300 according to the present disclosure, the actions of variable printer 332*a* are controlled by computer 390. Although only one computer 390 is shown in FIG. 6, it should be understood that system 300 can include multiple computers 390. Computer 390 can include a personal computer, a computer terminal, a personal digital assistant (PDA) and/or other types of devices as may occur to one of ordinary skill in the relevant art after being presented with the disclosure herein. In one embodiment, computer 390 is a personal computer. In at least one embodiment, a datafile of variable indicia is stored on computer 390, which computer is electronically interconnected with variable printer 332*a*. Such electronic interconnection may be accomplished by hardwiring, radio frequency communication, or such other forms of electronic interconnection as may occur to one of ordinary skill in the relevant art after being presented with the disclosure herein. As first label material 370 passes under or through variable printer 332*a*, computer 390 transmits data from the datafile to variable printer 332*a*, which data is output by variable printer 332*a* as variable indicia on first label material 370. In at least one embodiment of the present disclosure, variable printer 332*a* comprise computers, software, and printer systems provided by Scitex, Kodak, or other such providers.

In the embodiment of system 300 shown in FIG. 6, following variable printer 332*a*, first label material 370 is fed through print station 336, where other indicia (such as, for example, indicia 18*a*) may be printed on first label material 370. In at least one embodiment of system 300, print station 336 comprises a rotary flexographic print station. In other embodiments, print station 336 comprises a rotary letterpress printers, an offset printer, or a digital printer. In at least one embodiment of system 300, print station 336 is adapted to print a single color on first label material 370 as first label material 370 moves under or through print station 336 according to a predetermined printing pattern. The ink used in print station 336 is selected to be compatible with print station 336, first label material 370, and the intended use of the plurality of multi-part labels to be formed from first label material 370. Such inks may include water-based flexographic inks and UV curable inks. After being presented with the disclosure herein, one of ordinary skill in the relevant art will realize that other types of printers and other materials may be used to create indicia on first label material 370 without departing from the spirit and scope of the present disclosure.

In at least one embodiment of system 300 according to the present disclosure, print station 336 is adapted to print static indicia on first label material 370 as first label material 370 moves under or through print station 336, i.e., print station 336 is adapted to print the same indicia in the same pattern on each discrete multi-part label that is to be formed from the continuous roll or web of first label material 370. In at least one embodiment of system 300, the actions of print station 336 may be controlled by a computer (not shown in FIG. 6). For example, a computer may control the timing of print station 336, and/or the alignment and registration of first label material 370 and print station 336, and/or other functions of print station 336.

In at least one embodiment of system 300 according to the present disclosure, print station 336 may be adapted to apply a release coat material to first label material 370 as first label material 370 moves under or through print station 336. Where used, the release coat material is selected so as to be compatible with the adhesive backing of second label material 372 in promoting the desired removability of second label material 372. Where used, the release coat material is selected so as mitigate or eliminate the possibility that indicia that may be printed on first label material 370 will be defaced when second label material 372 is removed therefrom. Such a release coat may be applied in a predetermined release coat application pattern, such as a predetermined release coat application pattern that less than fully covers the label material component of first label material 370. Alternatively, such a release coat may be applied so that the release coat fully covers the label material component of first label material 370. In at least one embodiment of system 300 according to the present disclosure, print station 336 may be adapted to apply the same release coat in the same pattern on each discrete multi-part label that is to be formed from the continuous roll or web of first label material 370. The application of a release coat by print station 336 may be controlled by a computer (not shown in FIG. 6). For example, a computer may control the timing of print station 336, and/or the alignment and registration of first label material 370 and print station 336, and/or other functions of print station 336.

In the embodiment of system 300 shown in FIG. 6, following print station 336, first label material 370 is routed along and through guides 358, 360, and then through idler 354. Guides 358, 360 may be rollers. Second label material 372 is unwound from second material source 352 and also is fed through idler 354 where second label material 372 is laminated on top of first label material 370 to form multi-part label stock 378. The underside of second label material 372 comprises an adhesive such that after laminating second label material 372 on top of first label material 370, second label material 372 may later be removed completely from first label material 370 without damaging first label material 370 or the indicia that may be on first label material 370. Optionally, a release coating may be applied to first label material 370 at print station 336 to facilitate removability of second label material 372.

In the embodiment of system 300 shown in FIG. 6, following idler 354, multi-part label stock 378 is routed under or through one or more of print stations 324, 326, 328, 330, exposing second label material 372 to one or more of print stations 324, 326, 328, 330. One or more of print stations 324, 326, 328, 330 are adapted to print indicia (such as, for example, indicia 11*a*) on second label material 372 as multi-part label stock 378 moves under or through one or more of print stations 324, 326, 328, 330. In at least one embodiment of system 300, one or more of print stations 324, 326, 328, 330 comprise rotary flexographic print stations. In other embodiments, one or more of print stations 324, 326, 328, 330 comprise rotary letterpress printers, offset printers, and/or digital printers. After being presented with the disclosure herein, one of ordinary skill in the relevant art will realize that other types of printers may be used to create indicia on second label material 372 without departing from the spirit and scope of the present disclosure.

In at least one embodiment of system 300, each of print stations 324, 326, 328, 330 is adapted to print a single color ink on second label material 372 according to a predetermined printing pattern as multi-part label stock 378 moves under or through one or more of print stations 324, 326, 328, 330. The inks used in print stations 324, 326, 328, 330 are selected to be compatible with print stations 324, 326, 328, 330, second label material 372, and the intended use of the plurality of multi-part labels to be formed from second label material 372. Such inks may include water-based flexographic inks and UV curable inks. After being presented with the disclosure herein, one of ordinary skill in the relevant art will realize that other types of materials may be used to create indicia on second label material 372 without departing from the spirit and scope of the present disclosure.

In at least one embodiment of system 300 according to the present disclosure, one or more of print stations 324, 326, 328, 330 are adapted to print static indicia on second label material 372 as multi-part label stock 378 moves under or through one or more of print stations 324, 326, 328, 330, i.e., one or more of print stations 324, 326, 328, 330 are adapted to print the same indicia in the same pattern on each discrete multi-part label that is to be formed from the continuous roll or web of multi-part label stock 378. In at least one embodiment of system 300, the actions of one or more of print stations 324, 326, 328, 330 may be controlled by a computer (not shown in FIG. 6). For example, a computer may control the timing of print stations 324, 326, 328, 330, and/or the alignment and registration of multi-part label stock 378 and print stations 324, 326, 328, 330, and/or other functions of print stations 324, 326, 328, 330.

In the embodiment of system 300 shown in FIG. 6, following print stations 324, 326, 328, 330, multi-part label stock 378 is routed under or through second variable printer 332*b*, exposing second label material 372 to second variable printer 332*b*. Second variable printer 332*b* is adapted to print indicia (such as, for example, indicia 11*b*) on second label material 372. In at least one embodiment of system 300, variable printer 332*b* is an ink jet printer. In at least one embodiment of system 300, variable printer 332*b* may be a laser printer. The inks, toners, or other printing materials used in variable printer 332*b* are selected to be compatible with variable printer 332*b*, second label material 372, and the intended use of the plurality of multi-part labels to be formed from second label material 372. After being presented with the disclosure herein, one of ordinary skill in the relevant art will realize that other types of printers and other materials may be used to create indicia on second label material 372 without departing from the spirit and scope of the present disclosure.

In at least one embodiment of system 300 according to the present disclosure, second variable printer 332*b* is adapted to print variable indicia on second label material 372, i.e., second variable printer 332*b* is adapted to print different indicia on at least two of the discrete multi-part labels that are to be formed from the continuous roll or web of second label material 372. In at least one embodiment of system 300 according to the present disclosure, second variable printer 332*b* is adapted to print different indicia on each discrete multi-part label that is to be formed from the continuous roll or web of second label material 372. For example, second variable printer 332*b* may be adapted to print a different address on different discrete multi-part labels, or may be adapted to print a different bar code on different discrete multi-part labels, or may be adapted to print a different maxicode on different discrete multi-part labels, or may be adapted to print different billing account information on different discrete multi-part labels, or may be adapted to print a different tracking number on different discrete multi-part labels. After being presented with the disclosure herein, one of ordinary skill in the relevant art will realize that other types of variable indicia may be printed without departing from the spirit and scope of the present disclosure.

In at least one embodiment of system 300 according to the present disclosure, the actions of variable printer 332*b* are controlled by computer 390. Although only one computer 390 is shown in FIG. 6, it should be understood that system 300 can include multiple computers 390. Computer 390 can include a personal computer, a computer terminal, a personal digital assistant (PDA) and/or other types of devices as may occur to one of ordinary skill in the relevant art after being presented with the disclosure herein. In one embodiment, computer 390 is a personal computer. In at least one embodiment, a datafile of variable indicia is stored on computer 390, which computer is electronically interconnected with variable printer 332*b*. Such electronic interconnection may be accomplished by hardwiring, radio frequency communication, or such other forms of electronic interconnection as may occur to one of ordinary skill in the relevant art after being presented with the disclosure herein. As second label material 372 passes under or through variable printer 332*b*, computer 390 transmits data from the datafile to variable printer 332*b*, which data is output by variable printer 332*b* as variable indicia on second label material 372. In at least one embodiment of the present disclosure, variable printer 332*b* comprise computers, software, and printer systems provided by Scitex, Kodak, or other such providers.

In at least one embodiment of system for automated production of a plurality of multi-part labels according to the present disclosure, multi-part label stock including all indicia printed thereon may be finished by one or more optional finishing operations. For example, in the embodiment of system 300 shown in FIG. 6, following second variable printer 332*b* multi-part label stock 378, including all indicia printed thereon, is fed through a first die station 338. In this embodiment of system 300, at first die station 338, an undercut die cuts through both the liner component and the label material component of first label material 370, but not through the second label material 372, thereby creating a corner peel tab for one or more of the discrete multi-part labels that are to be formed from the continuous roll or web of multi-part label stock 378. In at least one embodiment of system 300, at first die station 338, an undercut die cuts only through the liner component of first label material 370, and not through the label material component of first label material 370 or through second label material 372, thereby creating a corner peel tab for one or more of the discrete multi-part labels that are to be formed from the continuous roll or web of multi-part label stock 378.

In another example of a finishing operation, in the embodiment of system 300 shown in FIG. 6, following first die station 338, multi-part label stock 378 is fed through a second die station 338, where a die cuts through second label material 372 and the label material component of first label material 370, but not through the liner component of first label material 370, thereby creating discrete multi-part labels that remain affixed to the liner component of first label material 370. It should be noted that it also is possible to die cut the boundaries of discrete multi-part labels before die cutting the corner peel tabs.

An additional die station 338 is shown in the embodiment of system 300 of FIG. 6. Such additional die station 338 optionally may be adapted for specialty die cutting and punching operations. Other embodiments of system 300 may adapted to include one or more additional optional die stations to meet the die cutting and punching needs of a particular multi-part label design.

In the embodiment of system 300 shown in FIG. 6, following die stations 338, multi-part label stock 378 is fed through an optional waste removal station 340. Waste removal station 340 is operable to remove all or substantially all of the portions of second label material 372 and the label material component of first label material 370 that are outside the boundaries of discrete multi-part labels affixed to the liner component of first label material 370, while leaving the discrete multi-part labels affixed to the liner component of first label material 370.

In the embodiment of system 300 shown in FIG. 6, following waste removal station 340, multi-part label stock 378 is fed through an optional slitter station 342. Slitter stations 342 may be used where multi-part label stock 378 is configured so that a plurality of streams of discrete multi-part labels are arranged across the width of multi-part label stock 378. Multi-part label stock 378, including the discrete multi-part labels affixed thereto, may be slit into individual streams of discrete multi-part labels at slitter station 342.

In the embodiment of system 300 shown in FIG. 6, following slitter station 342, multi-part label stock 378 may be fed through optional sheeter station 344 and optional fan folder 346. Optionally, in at least one embodiment of a system for automated production of multi-part labels according to the present disclosure, multi-part label stock 378 may finished by cutting perforations between discrete multi-part labels at sheeter station 344, which labels are then fan folded at the perforations into flat packs by fan folder 346. Optionally, in at least one embodiment of a system according to the present disclosure for automated production of multi-part labels, multi-part label stock 378 may finished by shearing, at sheeter

344, multi-part label stock 378 into discrete sheets, including the discrete multi-part labels affixed thereto.

Also shown in FIG. 6 is optional rewinder 348. In at least one embodiment of a system according to the present disclosure for automated production of multi-part labels, multi-part label stock 378 may finished by winding multi-part label stock 378, including the discrete multi-part labels affixed thereto, on a roll by rewinder 348. Where used, rewinder 348 is used in lieu of sheeter station 344 and fan folder 346, according to at least one embodiment of the present disclosure.

System 300 of FIG. 6 represents merely an exemplary embodiment of a system according to the present disclosure for automated production of multi-part labels. For example, although two variable printers are shown in the embodiment of system 300 shown in FIG. 6, the present disclosure is not limited to systems comprising two variable printers. Other embodiments of systems according to the present disclosure may comprise more than or less than two variable printers.

Also, for example, in systems according to the present disclosure for automated production of multi-part labels, the one or more print stations, one or more variable print stations, and one or more laminating processes may be arranged so that zero colors, one color, or a plurality of colors may be printed on the first label material and/or on the second label material, and/or on any other layer of label material that may be part of a multi-part label. Similarly, the one or more print stations, one or more variable print stations, and one or more laminating processes may be arranged so that a release coat may be applied to all, a portion, or none of the first label material and/or on the second label material, and/or on any other layer of label material that may be part of a multi-part label. Similarly, the one or more print stations, one or more variable print stations, and one or more laminating processes may be arranged so that variable indicia may be printed on the first label material and/or on the second label material, and/or on any other layer of label material that may be part of a multi-part label.

Also, for example, many embodiments of systems, methods, and labels disclosed herein discuss a plurality of multi-part labels comprising at least one liner-backed layer. Multi-part labels that do not comprise at least one liner-backed layer, and systems and methods related to the same, are within the scope of the present disclosure. For example, in lieu of a liner-backed layer, a multi-part label according to at least one embodiment of the present disclosure may comprise a layer backed with a dry gum adhesive or another form of adhesive. Each such embodiment of a multi-part label is within the scope of the present disclosure.

While this disclosure has been described as having a preferred design, the systems and methods according to the present disclosure can be further modified within the scope and spirit of this disclosure. This application is therefore intended to cover any variations, uses, or adaptations of the disclosure using its general principles. For example, the methods disclosed herein and in the appended claims represent one possible sequence of performing the steps thereof. A practitioner may determine in a particular implementation that a plurality of steps of one or more of the disclosed methods may be combinable, or that a different sequence of steps may be employed to accomplish the same results. Each such implementation falls within the scope of the present disclosure as disclosed herein and in the appended claims. Furthermore, this application is intended to cover such departures from the present disclosure as come within known or customary practice in the art to which this disclosure pertains and which fall within the limits of the appended claims.

What is claimed is:

1. A method for manufacturing a plurality of multi-part labels, the method comprising the steps of:

providing a first label material, said first label material comprising a first label face;

printing first indicia on said first label face in registration with an eventual location of at least one of a plurality of multi-part labels, said first indicia being variable between at least two of said plurality of multi-part labels;

applying a release coat material to said first label face in registration with an eventual location of at least one of said plurality of multi-part labels, wherein said release coat material covers substantially all of said first label face;

removably adhering a second label material to said first label material, said second label material covering said first indicia, said second label material comprising a second label face; and printing second indicia on said second label face in registration with said first indicia on said first label face, said second indicia being variable between at least two of said plurality of multi-part labels.

* * * * *